US007127749B2

(12) United States Patent
Ling

(10) Patent No.: US 7,127,749 B2
(45) Date of Patent: Oct. 31, 2006

(54) INFRARED SENSOR FLUSHING CONTROL METHOD AND PLUMBING FIXTURE FLUSHING SYSTEM

(76) Inventor: Ligong Ling, Rm 901, Bldg. 27, Jinan Garden, Tian He District, Guangzhou, Guangdong (CN)

( * ) Notice: Subject to any disclaimer, the term of this patent is extended or adjusted under 35 U.S.C. 154(b) by 169 days.

(21) Appl. No.: 10/888,797

(22) Filed: Jul. 9, 2004

(65) Prior Publication Data

US 2005/0028260 A1 Feb. 10, 2005

(51) Int. Cl.
*E03D 13/00* (2006.01)

(52) U.S. Cl. ..... 4/304; 4/661; 4/305; 4/313; 4/DIG. 3

(58) Field of Classification Search ..... 4/303–305, 4/661, 313, 406, DIG. 3
See application file for complete search history.

(56) References Cited

U.S. PATENT DOCUMENTS 5,508,510 A * 4/1996 Laverty et al. ..... 4/304
5,603,127 A * 2/1997 Veal ..... 4/313

* cited by examiner

*Primary Examiner*—Khoa D. Huynh
(74) *Attorney, Agent, or Firm*—Raymond Y. Chan; David and Raymond Patent Firm

(57) ABSTRACT

An infrared sensor flushing control method and the plumbing fixture flushing system. The realization of flushing with two different jets is achieved by using the infrared sensor and MCU to control the electromagnetic-controlled valves. The MCU preinstalled with three different solid waste flushing procedures and one liquid waste flushing procedure, providing the water-saving consumption according to the requirements of each individual and the automatic discrimination of the usage. The integrated design also accomplishes the purpose of convenient installation and space saving.

6 Claims, 5 Drawing Sheets

INFRARED SENSOR FLUSHING CONTROL METHOD AND PLUMBING FIXTURE FLUSHING SYSTEM

BACKGROUND OF THE PRESENT INVENTION

1. Field of Invention

This present invention relates to a plumbing fixture and a flushing method, and more particularly to an infrared sensor technology applied in a flushing control method and a plumbing fixture flushing system.

2. Description of Related Arts

The most common plumbing fixture design is a manually-operated flushing system in a plumbing fixture with a float-ball-controlled toilet tank. However, this specific plumbing fixture design is superannuated. Drawbacks of this design are low reliability, frequent malfunction, waste of water in each flush, and sanitation hygiene problem owing to operation of this specific commode design with bare hand. Because of the demand for plumbing fixture with water saving function, the retrofit of the manually-operated float-ball-controlled plumbing fixture is achieved by, for instance, using electromagnetic-controlled valve, especially in combination with the infrared technology into the automatic flushing system, yet mostly on the urinal flushing system and poorly performed in the excrement flushing. Since the retrofit only uses single electromagnetic-controlled valve to control, without modification on the flushing method, the water consumption is still considerably high. If the single electromagnetic-controlled valve controller is redesigned to meet the requirement of the sufficient flushing discharge quantity for excrement or solid waste, the overall volume of this controller integrating into the plumbing fixture would be increased, hence, it is difficult to install.

SUMMARY OF THE PRESENT INVENTION

A main object of the present invention is to provide an automatic water-saving flushing control method and system thereof, wherein the method is capable of achieving different modes of flushing in accordance with each individual's requirements and consequently having the advantages of water-conserving and better flushing effect, wherein the whole system also provides the convenient installation and minimum volume with integrated structure into the plumbing fixture.

Accordingly, in order to accomplish the above object, the present invention provides an infrared sensor flushing control method, comprising the steps of:

a) providing a pulse signal for an infrared sensor through a single chip microprocessor control unit (MCU) installed with liquid and solid waste flushing procedures;

b) generating an infrared signal in response the pulse signal which is first amplified and then emitted to an object within the detection range of the infrared sensor;

c) transmitting a reflected infrared signal reflected by the object within the detection range of the infrared sensor to the single chip MCU, wherein the reflected infrared signal is amplified before transmitting to the single chip MCU;

wherein the MCU checking the feedback signals reflected by an object within the detection range of the infrared sensor and discriminating the feedback signals to take a necessary procedure accordingly; which specific procedure should be selected is determined on the rules as follows:

when an object enters within the detection range of the infrared sensor for shorter than or equal to a default period of time, a command-operating unit performs a liquid waste flushing procedure, when an object enters within the detection range of the infrared sensor for longer than or equal to a default period of time, the command-operating unit performs a solid waste flushing procedure; and a series of flushing command signals transmitted from the MCU, wherein the series of flushing command signals are amplified to drive the command-operating unit, hence conducting a flushing mechanism.

The control method includes the pulse signal with 10% duty cycle in frequency 1 Hz, such as a pulse width of 100 microseconds and a period of 1 second, and the command-operating unit composed of either a set of two independent electro-magnetic-controlled valves or a set of one-in-two-out two-series electromagnetic-controlled valve.

Another object of the present invention is to provide the control method to follow a set of decision-making processes, concerning how the MCU discriminates the feedback signals and what different flushing mechanism is conducted after the discrimination is being affirmed; which specific procedure should be selected is determined on the rules as follows:

after an object enters within the detection range of the infrared sensor for 5 to 7 seconds, the MCU sends command to the electromagnetic-controlled valve to start a rinsing procedure, after an object enters within the detection range of the infrared sensor for less than or equal to 59~60 seconds, when the object leaves, the MCU sends command to the electromagnetic-controlled valve to start the liquid waste flushing procedure, after an object enters within the detection range of the infrared sensor for more than 60 seconds, when the object leaves, the MCU sends command to the electromagnetic-controlled valve to start the solid waste flushing procedure.

Another object of the present invention is to provide a control method, wherein the corresponding flushing procedures are as follows: A). the rinsing procedure is to command a upper jet to discharge a flushing water to rinse the inner surface of the toilet bowl; B). the liquid waste flushing procedure is to command a lower jet to discharge flushing water to drain the liquid waste out through the trapway, and then the upper jet discharge the flushing water to rinse the inner surface of a toilet bowl; C). the solid waste flushing procedure is to conduct rinse-drain-refill in sequence.

Another object of the present invention is to provide a control method, wherein each user could set high, medium, or low flushing power in accordance with varied purposes of flushing requirements and different hydraulic pressure conditions.

Another object of the present invention is to provide a control method, wherein the user regains the control from the automatic flushing system to a mechanical flushing override, which means once the selection of the liquid or solid waste flushing procedure is determined manually, the automatic infrared sensor flushing mechanism stops functioning.

Another object of the present invention is to provide a plumbing fixture flushing system to attain the aim of water-saving consumption and eventually eco-friendly sanitary ware by employing both an automatic control circuit to command the electromagnetic-controlled valves and a set of flushing water jets that connect to the electromagnetic-controlled valves.

Accordingly, in order to accomplish the above object, the present invention provides a plumbing fixture flushing system, comprising:

the automatic control circuit composing of a MCU in which different flushing control procedures are installed, a signal-amplifying circuit, and the infrared sensor;

the MCU transmitting signals to the signal-amplifying circuit to control the electromagnetic-controlled valves and then initiating different flushing procedures according to the feedback signals received by the infrared sensor, wherein each individual user may switch the operating mode between automatic mode and manual mode in compliance with the personal preference or the status of usage;

the infrared sensor, included in the automatic control circuit, composed of a infrared emitter and a infrared receiver, wherein a series of the infrared signals transmitted from the MCU into the signal-amplifying circuit and then emitted by the infrared emitter to detect any object within the detection range of the infrared sensor are reflected by any object and are received by the infrared receiver within the detection range of the infrared sensor, so as to provide the MCU to check and discriminate the feedback signals, the reflected infrared signals, to initiate the corresponding flushing procedures preinstalled in the MCU.

Another object of the present invention is to provide a plumbing fixture flushing system with the upper and the lower jets controlled by two apparatus, wherein the first apparatus for controlling the upper and the lower jets are the electro-magnetic-controlled valves and the second apparatus are a pair of unidirectional valves which are on the aqueducts between the electromagnetic-controlled valves and the jets, respectively.

Another object of the present invention is to provide a plumbing fixture flushing system with the electromagnetic-controlled valves designed as a one-in-two-out two-series electromagnetic-controlled valve and the signal-amplifying circuit which is either a switching amplifier for a pulse-triggered electromagnetic-controlled valve or an amplifier for a DC-power electromagnetic valve.

The present invention in the flushing method and plumbing fixture flushing system reduce the volume of each plumbing fixture by removing the toilet tank and integrate with the electro-automatic control flushing system to achieve a better flushing result. The plumbing fixture flushing system uses an apparatus of one-in-two-out two-series electromagnetic-controlled valves to control the flushing water in two aqueducts, respectively. Two aqueducts are connected to the unidirectional valves, respectively, and to the upper and lower jets, respectively, to function as a pair of conduits for the flushing water in each usage. With the MCU and the infrared sensor, the flushing system operates in compliance with default setting of flushing procedures to perform the cleansing process by the flushing water through the upper and the lower jets, providing a convenient integrated installation, a maximum flushing quality in minimum water consumption, and a automatic flushing procedure selection including: A). Rinse the inner surface of toilet bowl. B). Cleanse with the jet of flushing water. C). Discharge of the liquid and/or solid waste. D). Refill to prevent the odor from trapway.

These and other objectives, features, and advantages of the present invention will become apparent from the following detailed description, the accompanying drawings, and the appended claims.

DETAILED DESCRIPTION OF THE PREFERRED EMBODIMENT

Figure 1:
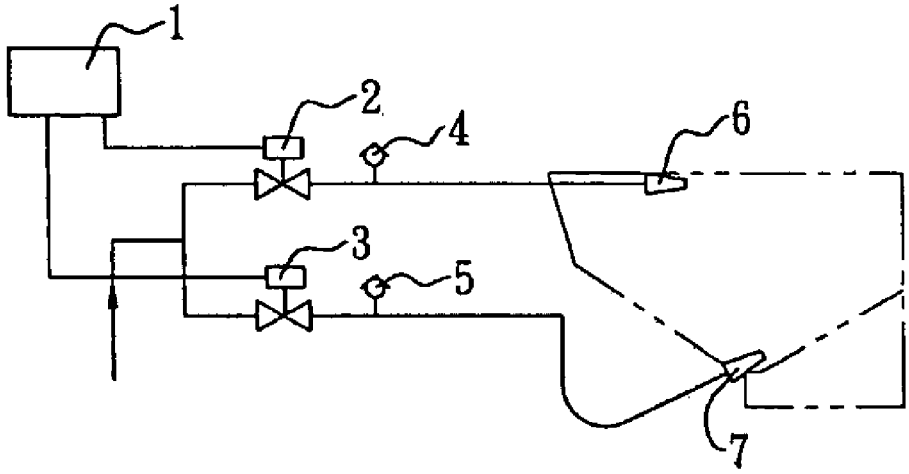
FIG. 1 is a schematic diagram of the plumbing fixture flushing system of the present invention.
Figure 2:
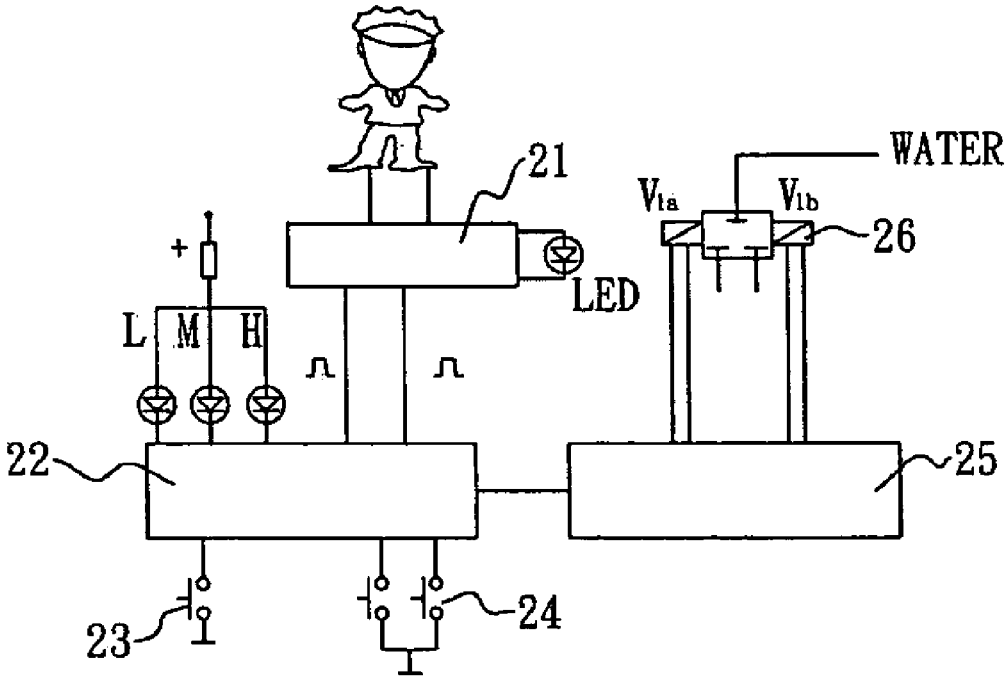
FIG. 2 is a schematic diagram of a preferred embodiment of the present invention in FIG. 1.
Figure 3:
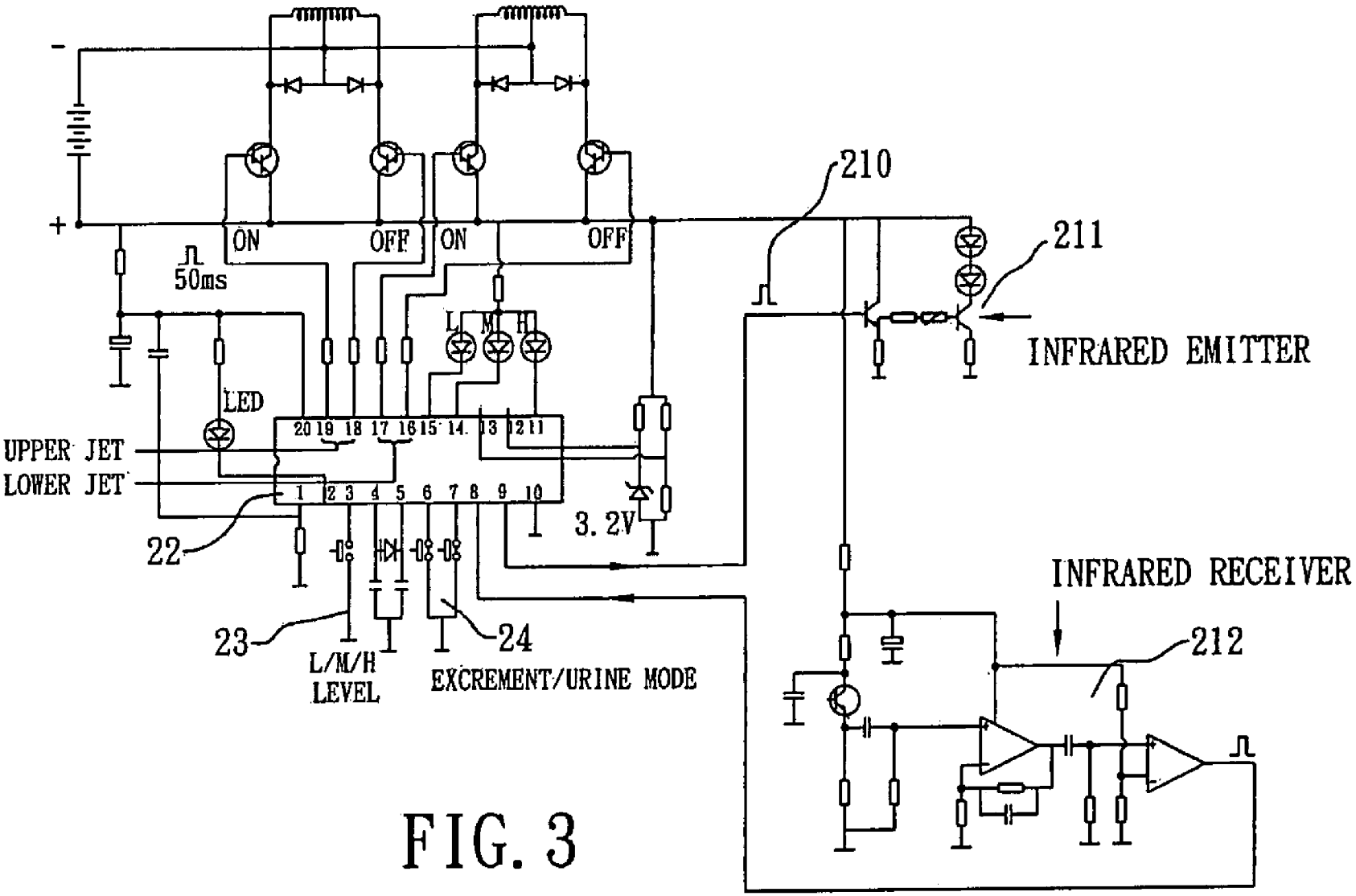
FIG. 3 is a schematic diagram of a flushing system circuit design of the above preferred embodiment of the present invention.

Referring to FIGS. 1 to 3 of the drawings, the automatic controller 1 comprises infrared sensor 21, MCU 22, flushing power selection 23, liquid/solid waste flushing mode selection 24, amplifier 25, and a one-in-two-out two-series electromagnetic-controlled valve 26 according to the preferred embodiment of the present invention. The MCU 22 is installed with one flushing procedure for liquid waste and three flushing procedures for solid waste in different flushing power, which could be access through the flushing power selection 23. The flushing mode selection 24 is designed for switching between automatic and manual flushing control. The manual flushing control guarantees the automatic control flushing process to function applicably even if the automatic flushing system collapses. The MCU 22 of the present invention is exchangeable with the programmable logic device to program the desired procedures according to different usages and each user's requirements.

The following list illustrates the detail settings of the flushing power selection of the present invention:

| | 00 Upper Jet | 01 Upper Jet | 02 Lower Jet | 03 Upper Jet | Total amount of time |
|---|---|---|---|---|---|
| Low | Ready | 2.5 sec. | 3 sec. | 1 sec | 7 sec. |
| Med. | 0.5 sec. | 3 sec. | 4 sec. | | 8.5 sec. |
| High | | 4 sec. | 5 sec. | | 9.5 sec. |

For example, when an object is entered into a detection area, the MCU 22 generates a pulse signal per second. When an object stays in the detection area for 5 minutes, the MCU generates 5 pulse signals and so starts to operate. A $V_{1a}$ of the electromagnetic-controlled valve 26 will first closed and a one second rinsing process starts for rinsing the toilet bowl. At the same time, the MCU starts to calculate and will sending command for liquid waste flushing process if less than 60 pulse signals are generated and detected. Then the $V_{1b}$ of the electromagnetic-controlled valve 26 releases for three second for flushing, and the $V_{1a}$ sprays water for two second to rinse the toilet bowl. When more than 60 pulse signals are generated and detected by the MCU, the MCU will initiate a solid flushing waste process comprising the steps of flushing the toilet bowl, draining the toilet bowl, and refilling flushing water or blocking any odor smell.

Referring to FIG. 2 and FIG. 3 of the drawings, the MCU 22 transmits a series of pulse signals 210, with frequency 1 Hz and 10% duty cycle, to the infrared sensor 21. After the series of pulse signals 210 is amplified by the signal-amplifying circuit, it is emitted by the infrared emitter 211. The infrared receiver 212 of the infrared sensor 21 would detect any feedback infrared signals if any object is within the adjustable detection range of the infrared sensor 21. Once the feedback signals are being amplified by the signal-amplifying circuit after received, the MCU 22 would check and discriminate according to the pre-installed decision rules.

Figure 4:
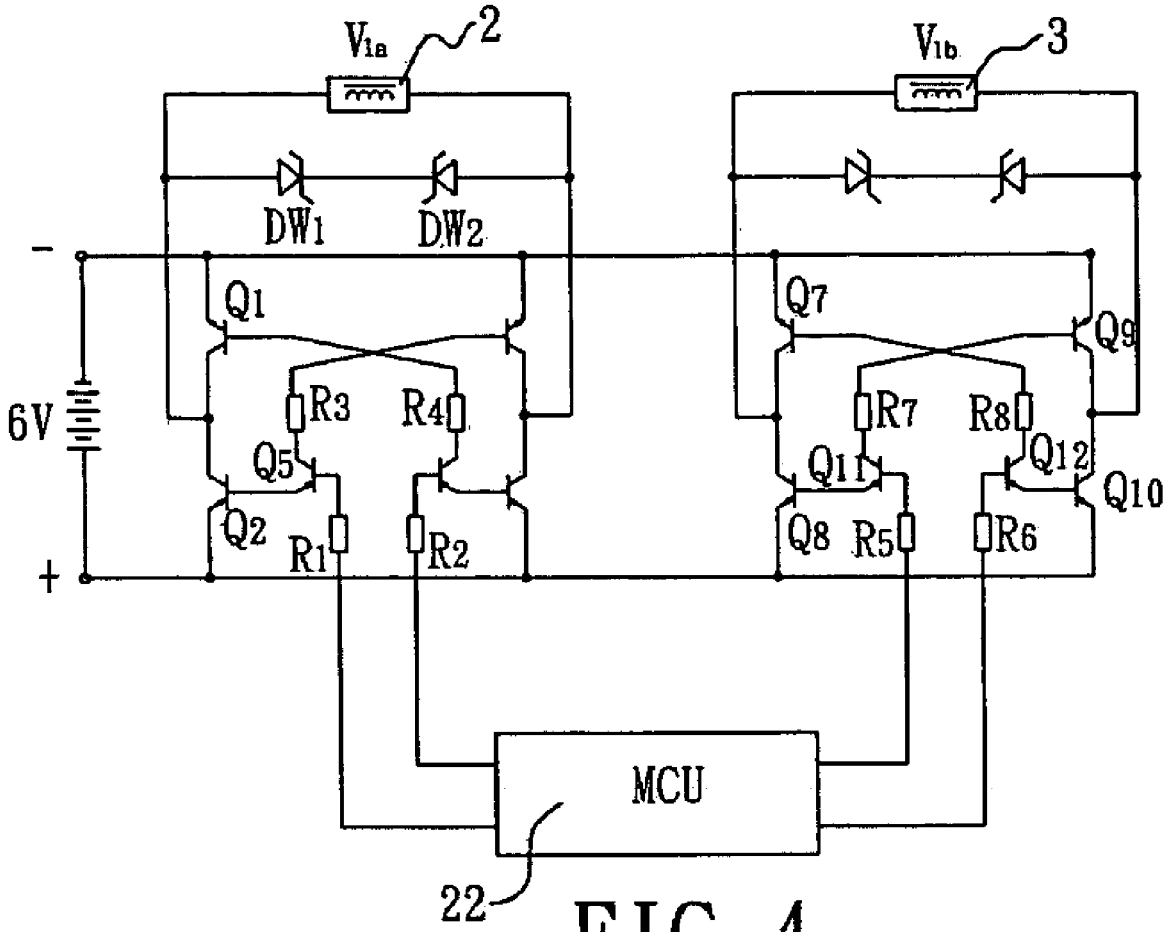
FIG. 4 is a schematic diagram of a switching amplifier for pulse-triggered electromagnetic valve according to the above preferred embodiment of the present invention.
Figure 5:
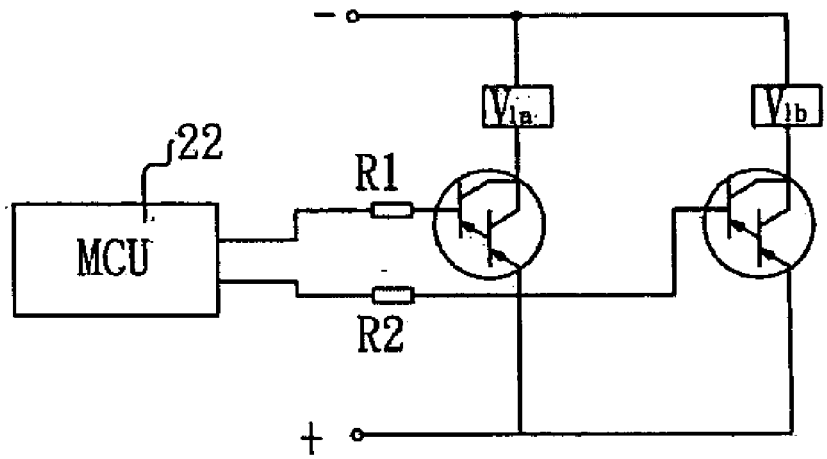
FIG. 5 is a schematic diagram of an amplifier for DC-power electromagnetic valve according to the above preferred embodiment of the present invention.

The amplifier 25 could be the triode amplifying circuit to set between the MCU 22 and the electromagnetic-controlled valve 26, or simply using pulse-triggered electromagnetic-controlled valve which could be switch on by applying a positive voltage equal to or longer than 50 microsecond and switch off by applying a negative voltage equal to or longer than 50 microsecond. The pulse-amplifying circuit and the pulse-switching bridge circuit are showing in the FIG. 4 and the pulse high and low widths are set by the MCU 22.

Referring to FIG. 1 of the drawings, the flushing system of a plumbing fixture in the present invention comprises automatic controller 1, electromagnetic-controlled A valve 2, electromagnetic-controlled B valve 3, unidirectional valves 4 and 5, upper jet 6, and lower jet 7.

The realization of the two-aqueduct flushing system of a plumbing fixture is achieved by using both electromagnetic-controlled A valve 2 and B electromagnetic-controlled B valve 3 to control the flow in each aqueduct. The design of combining a water intake with two water outlets into a single water valve greatly reduce the size of the flushing control apparatus, and with supplementary unidirectional valves 4 and 5 on the aqueducts, this design is even feasible on the flush toilet.

The unidirectional valves 4 and 5 are installed on the aqueducts between the electromagnetic-controlled valves 2 and upper jet 6, and electromagnetic-controlled valves 3 and lower jet 7, respectively. This installation provides the safety control which prevents the flushing water from being contaminated by the toilet water in the toilet bowl due to the failure of shutting electromagnetic-controlled valves 2 and 3 timely or the vacuum between electromagnetic-controlled valves 2 and 3 and the jets 6 and 7, respectively, resulting in the siphon phenomenon.

When the flushing system is not in process of flushing, the loophole of the unidirectional valve is not occluded and connects to the atmosphere. Once the electromagnetic-controlled valve switches on and starts flushing water into the aqueduct, the hydraulic pressure lifts the seal in the unidirectional to obstruct the loophole against the atmospheric pressure so that the flushing water is toward the jet without overflowing into the loophole causing leakage problem.

After the electromagnetic-controlled valve switches off and stops flushing water into the aqueduct, the seal in the unidirectional valve descends by gravity and atmospheric pressure, which the airway of the loophole is not occluded, again. Even the siphon phenomenon occurs for some reason, it would only draw in the atmosphere from the loophole of the unidirectional valve, which provides an airway block to ensure that the contaminated water is not accessible to the electromagnetic-controlled valve. While the pressure of the residue of the flushing water does not suffice for pushing outward through the jet, it remains in the bent part of the aqueduct, which, provides as a block between the toilet water and the electromagnetic-controlled valve, another protection design.

Figure 7:
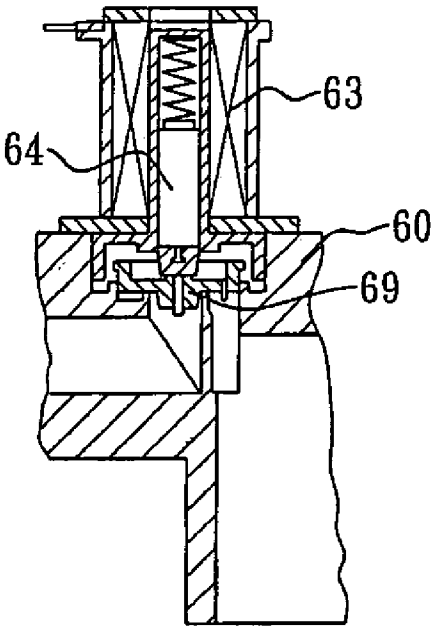
FIG. 7 is a partial structural diagram of a one-in-two-out two-series electromagnetic-controlled valve without decompression void according to the above preferred embodiment of the present invention.
Figure 6:
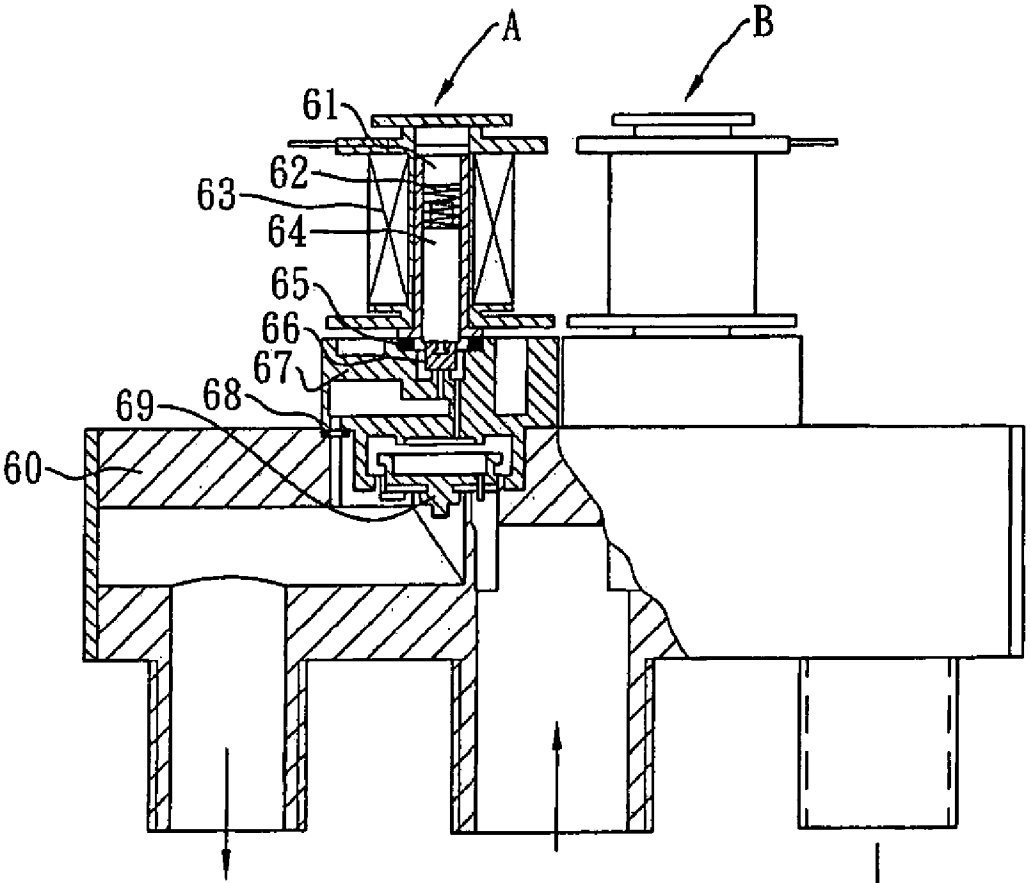
FIG. 6 is a structural diagram of a one-in-two-out two-series electromagnetic-controlled valve with decompression void according to the above preferred embodiment of the present invention.
Figure 8:
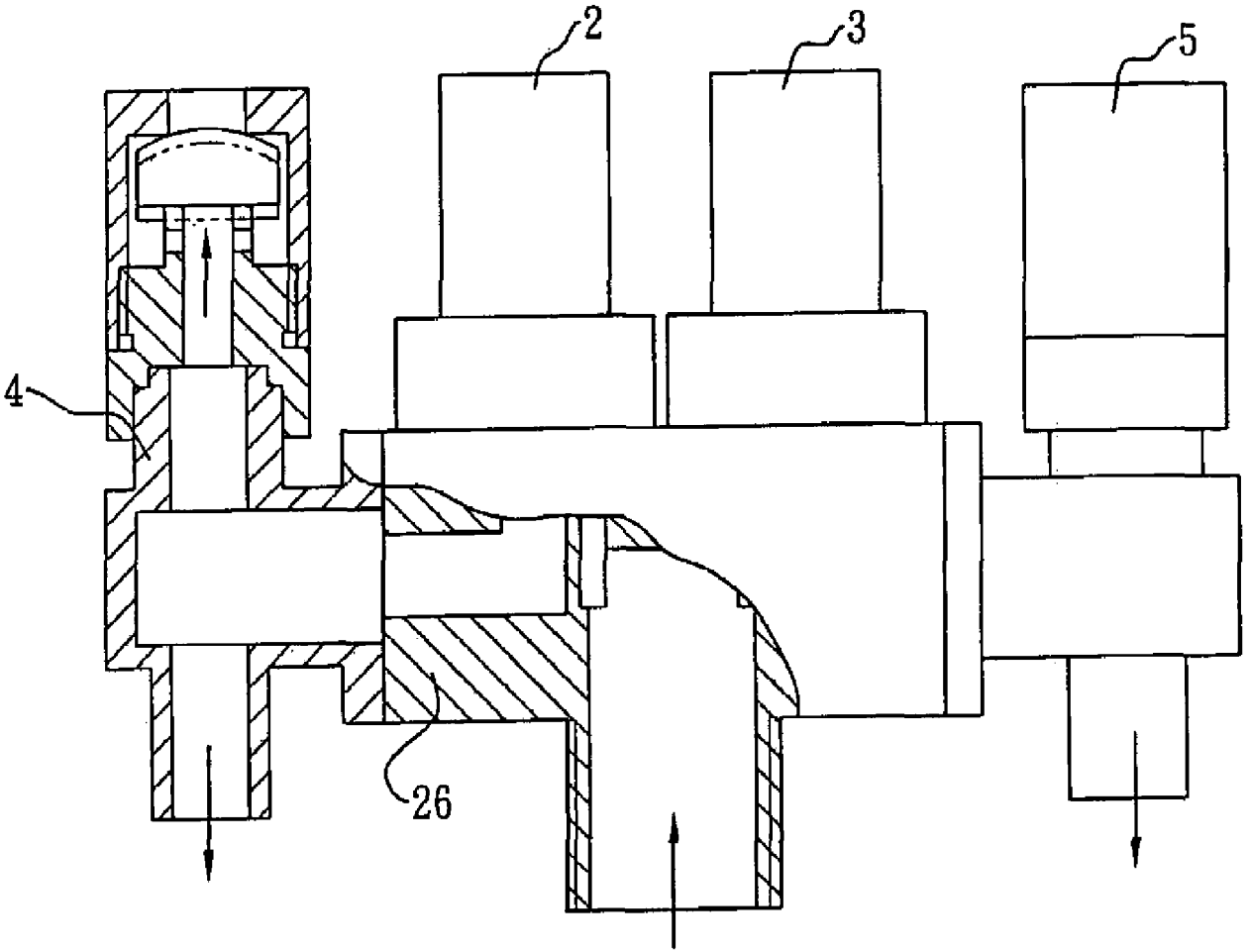
FIG. 8 is a schematic diagram of the one-in-two-out two-series electromagnetic-controlled valve with the built-in unidirectional valve according to the above preferred embodiment of the present invention.

Referring to FIGS. 6 to 8 of the structural drawings, two electro-magnetic-controlled valves are designed to join on the same platform to form a set of one-in-two-out two-series electromagnetic-controlled valves according to the preferred embodiment of the present invention. The width of the above electromagnetic-controlled valve is 50 millimeters so that the discharge quantity of the flushing water is sufficient enough to qualify the design requirement. The main body of the valve with a 12 or 24 volts low voltage DC current, built up by one-step injection molding, greatly improves the convenience of installation, as compared with the most common valve: equilibrium electromagnetic water valve without on/off function. According to the FIG. 6 of the preferred embodiment of the present invention, pulse-triggered electromagnetic-controlled valves A and B consist of the permanent magnet 61, the spring 62, the coil 63, the armature 64, the seal 65, the washer 66, decompression void 67, O-ring 68, valve core 69, and valve 60.

When the valve core 69 and the valve 60 are separated to switch on the valve itself, the positive voltage is applied to the coil 63 to polarize the armature 64 to have the attracting force with the permanent magnet 61 in opposite polarity against the pulling force of the string 62. When the valve core 69 and the valve 60 are shut to switch off the valve itself, the negative voltage is applied to the coil 63 to polarize the armature 64 in the same polarity with the permanent magnet 61 and, consequently, repel away from each other. The switch-on interval for polarization requires only 0.05 sec to complete, which means a single 6-volt alkaline battery could last approximately two and a half year without the need for replacement. The FIG. 7 shows an optional structure for a set of one-in-two-out two-series electromagnetic-controlled valves without decompression void. If the volume saving is the first priority, an more compact structure is available in integrating the unidirectional valve with the set of one-in-two-out two-series electromagnetic-controlled valves according in FIG. 8.

The MCU 22 does not send any command signals until receiving 5 infrared pulse signals from the infrared sensor 21. After the infrared sensor 21 detects an object is within the detection range for 5 seconds, in this case, the electromagnetic-controlled A valve 2 switches on for 1 second to flush the inner surface of the plumbing fixture. If the object stays within the detection range for longer than 60 seconds, the flushing system discriminates the solid waste flushing procedure should be executed. If shorter than or equal to 60 seconds, the liquid waste flushing procedure is executed. The solid waste flushing procedure with medium flushing power is as follows: 1). the electromagnetic-controlled A valve 2 switches on for 3 seconds to let the upper jet 6 flush. 2). the electromagnetic-controlled B valve 3 switches on for 4 seconds to let the lower jet 7 flush. 3). the electromagnetic-controlled A valve 2 switches on for 2 seconds to let the upper jet 6 refill both the water in the toilet bowl and the water in the bent part of the aqueduct. The liquid waste flushing procedure is as follows: 1). the electromagnetic-controlled B valve 3 switches on for 3 seconds to let the lower jet 7 flush. 2). the electromagnetic-controlled A valve 2 switches on for 2 seconds to let the upper jet 6 flush.

The present invention provides a two ways electromagnetic valve with an upper outlet and an lower inlet system. The flushing effect is effective and has an advantage of saving water. The construction of the present invention is simplified whereas the number of pipe elements is reduced and the installation is more convenience. The electromagnetic valves may be as small as 50 mm in size which is easy to arrange in different position. The two inlets are incorporated under one electromagnetic valve which can be manufactured in one mounding and hence is more convenience for manufacture. The MCU may store four different flushing processes suitable for operation under different pressure conditions for different area such that different individual's needs are met. The MCU can also analyze the action of an object to determine whether a liquid waste flushing process or a solid waste flushing process is suitable for each situation, thus achieving the purpose of saving water. The volume of flushing water used may be controlled between 2.8 and 3.2 liter. Since the system is operated under pulse signal system, the work is not high and is suitable for long time period. The present invention is safe and reliable, and easy to install. A unidirectional value is also used for defining an enclosed environment such that any gas or water is stopped and a hygiene environment can be maintained.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An infrared sensitive flushing method adapted for flushing a toilet bowl in an automatic mode, comprising the steps of:

a) providing a pulse signal for an infrared sensor through a microprocessor control unit (MCU) installed with a liquid and solid waste flushing system;

b) amplifying the pulse signal adapted for directing the pulse signal to an object in a detection area, and generating an infrared signal in response to the amplified pulse signal; and c) amplifying a reflected infrared signal reflected by the object in the detection area and transmitting the reflected infrared signal to the MCU;

wherein the reflected signal is analyzed by the MCU by a process of detecting and analyzing signal comprising the steps of:

a') generating a command signal in response to the reflected signal, wherein the command signal is a first signal of performing a liquid waste flushing procedure for a command-operating unit when the object stays in the detection area for shorter than or equal to a first default period of time, wherein the command signal is a second signal of performing a solid waste flushing procedure for a command-operating unit when the object stays in the detection area for longer than a second default period of time; and b') amplifying the command signal wherein the process of detecting and analyzing signal further comprises a step of generating a preliminary command signal which is a starting signal of preliminary rinsing for the command-operating unit when the object stays in the detection area for a default period of time longer than or equal to 5 seconds before step (a') such that the command-operating unit starts performing a rinsing process, wherein in the process of detecting and analyzing signal the first default period of time is 60 seconds and the second default period of time is 60 seconds, adapted for transmitting to a command-operating unit such that the command operating unit conduct a flushing according to the command signal.

2. The method, as recited in claim 1, wherein the pulse signal has 10% duty cycle in frequency 1 Hz and the command-operating unit is selected from the group of a set of two independent electro-magnetic-controlled valves and a set of one-in-two-out two-series electromagnetic-controlled valve.

3. The method, as recited in claim 1, wherein the rinsing process comprises a step of commanding an upper jet of the toilet bowl to discharge a quantity of water to rinse an inner surface of the toilet bowl, wherein the liquid waste flushing process comprises a step of commanding a lower jet of the toilet bowl to discharge a quantity of flushing water adapted for draining a liquid waste out through a trapway prior to the upper jet discharging a quantity of flushing water so as to rinse the inner surface of the toilet bowl, wherein the solid waste flushing process comprises the steps of conducting a rinsing action, a draining action and a refilling action respectively.

4. The method, as recited in claim 1, further comprising a step of providing a high operating mode, a medium operating mode and a low operating mode adapted for providing a high flushing power, a medium flushing power and a low flushing power respectively in accordance to a predetermined purpose of flushing and a predetermined hydraulic pressure condition determined by a user.

5. The method, as recited in claim 4, further comprising a step of disabling the pulse signal in step (a) and providing a mechanical method of flushing such that the command operation unit is disabled and the flushing is controlled by the user.

6. The method, as recited in claim 1, further comprising a step of disabling the pulse signal in step (a) and providing a mechanical method of flushing such that the command operation unit is disabled and the flushing is controlled by the user.

* * * * *